US006007186A

United States Patent [19]

Erni

[11] Patent Number: 6,007,186

[45] Date of Patent: Dec. 28, 1999

[54] THERMAL INK JET WITH HALF-SELECT THERMAL ADDRESSING

[75] Inventor: Ernst R. Erni, Encinitas, Calif.

[73] Assignee: Hewlett-Packard Company, Palo Alto, Calif.

[21] Appl. No.: 09/276,090

[22] Filed: Feb. 4, 1999

Related U.S. Application Data

[63] Continuation of application No. 08/589,073, Jan. 23, 1996, abandoned.

[51] Int. Cl.[6] ..... B41J 2/05

[52] U.S. Cl. ..... 347/59

[58] Field of Search ..... 347/56–59

[56] References Cited

U.S. PATENT DOCUMENTS 4,458,256 7/1984 Shirato et al. ..... 347/58

5,103,246 4/1992 Dunn ..... 347/58

*Primary Examiner*—John Barlow
*Assistant Examiner*—Juanita Stephens

[57] ABSTRACT

Thermal ink jet apparatus includes an ink jet pen with a plurality of ink ejection nozzles. Associated with each nozzle is a first resistor and second resistor. A feed channel introduces a quantum of ink into thermal communication with each first resistor and second resistor. The quantum of ink requires a level of applied thermal energy of $E_{min}$ to be caused to be ejected from the associated nozzle. An X-Y matrix drive circuit selectively applies a half-select address current to a first resistor and a half-select address current to a second resistor, both resistors located at a common nozzle. Each half-select current is insufficient to cause a resistor to emit $E_{min}$ thermal energy, but both half-select currents cause the first and second resistors to couple at least $E_{min}$ of thermal energy to the co-located quantum of ink so as to enable an ejection thereof.

7 Claims, 5 Drawing Sheets

THERMAL INK JET WITH HALF-SELECT THERMAL ADDRESSING

This application is a continuation of Ser. No. 08/589,073 filed Jan. 23, 1996, now abandoned.

FIELD OF THE INVENTION

This invention relates generally to thermal ink jet printing and, more particularly, to apparatus for providing half-select thermal addressing of each ink jet ejection nozzle.

BACKGROUND OF THE ART

Thermal ink jet pens commonly utilize heater resistors that are placed on a common substrate and are aligned with individual ink reservoirs and corresponding ink ejection nozzles. The heater resistors are electrically driven by conductive traces which are photolithographically formed on the surface of a suitable resistor material, such as tantalum-aluminum. The heater resistors are isolated from the overlying ink reservoir by an inert dielectric material.

To reduce the number of conductors required to drive the heater resistors, the prior art has combined the resistors with diodes to enable the resistors to be formed into an X-Y matrix which is, in turn, driven by a multiplexing circuit. Such an arrangement is shown in U.S. Pat. No. 4,695,853 to Hackleman et al., assigned the same Assignee as this patent application. U.S. Pat. No. 5,103,246 to Dunn, assigned to the same Assignee as this patent application, describes a technique for configuring such an X-Y electrical multiplexing arrangement so as to enable highly dense packing of the heater resistors. In each reference, a single resistor is employed per ink jet ejection nozzle.

U.S. Pat. No. 5,134,425 to Yeung, assigned to the same Assignee as this patent application, shows a further X-Y addressing matrix for plural ink jet heater resistors. Yeung describes a circuit which addresses the problem of parasitic voltages which appear across non-addressed heater resistors when plural addressed heater resistors are subjected to drive voltages. The parasitic voltages result from current flowing through non-addressed resistors along alternate paths between a drive voltage source and electrical ground. The preferred embodiment disclosed by Yeung drives each heating element in the matrix with a specified voltage and applies constant voltages across non-addressed heating elements, thus limiting the variations in total power dissipation of all heating elements. The power dissipated by each non-addressed heating element is less than or equal to ¼ of the power that is dissipated by an addressed heating element, thus reducing the danger of misfiring in any particular print head design.

Notwithstanding the success of prior art ink jet driving apparatus and circuitry, there is a continuing demand to achieve both simplification of the driving circuitry and reduced cost. Further, there is a need to assure that whatever driving technique is utilized enables reliable operation of the ink jet pen.

Accordingly, it is an object of this invention to provide an improved apparatus for selecting and driving individual ink jet nozzles.

It is another object of this invention to provide a simple structure that enables an X-Y multiplexed drive circuitry to selectively address ink nozzles.

It is yet another object of this invention to provide an improved apparatus and method for controlling addressing of individual ink jet nozzles.

SUMMARY OF THE INVENTION

Thermal ink jet apparatus includes an ink jet pen with a plurality of ink ejection nozzles. Associated with each nozzle is a first resistor and second resistor. A feed channel introduces a quantum of ink into thermal communication with each first resistor and second resistor. The quantum of ink requires a level of applied thermal energy of $E_{min}$ to be caused to be ejected from the associated nozzle. An X-Y matrix drive circuit selectively applies a half-select address current to a first resistor and a half-select address current to a second resistor, both resistors located at a common nozzle. Each half-select current is insufficient to cause a resistor to emit $E_{min}$ thermal energy, but both half-select currents cause the first and second resistors to couple at least $E_{min}$ of thermal energy to the co-located quantum of ink so as to enable an ejection thereof.

DETAILED DESCRIPTION OF THE INVENTION

Figure 1:
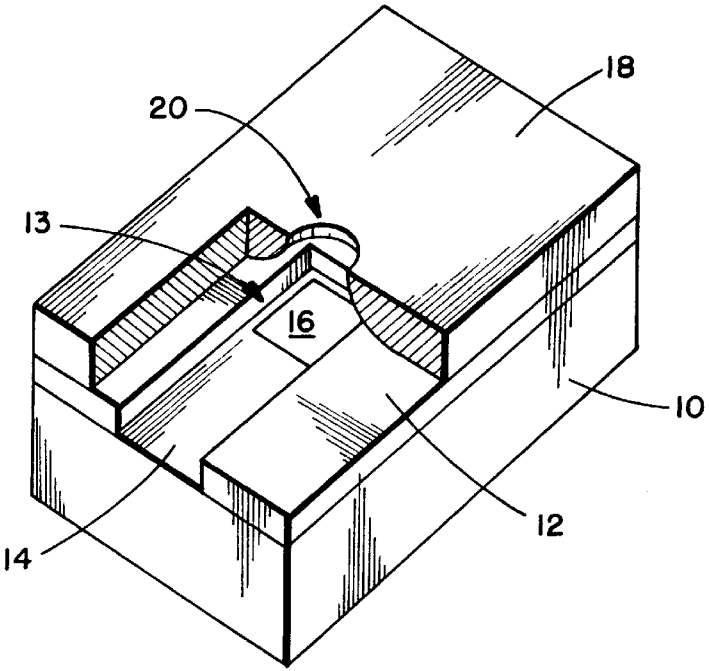
FIG. 1. ( PRIOR ART )
FIG. 1 is a perspective view of a portion of an ink jet pen.

FIG. 1 illustrates a portion of a prior art ink jet pen and shows a representative ink jet nozzle and its underlying structure. A substrate 10 supports a barrier plate 12 which isolates an ink chamber 13 from adjacent ink chambers. Barrier plate 12 further provides an input channel 14 which enables a quantum of ink to be fed into ink chamber 13 and to overlay a heater resistor 16. A nozzle plate 18 forms the ink jet emitting surface and includes a nozzle 20 directly aligned over chamber 13 and heater resistor 16. When an appropriate current is applied to heater resistor 16, an amount of energy equal to or greater than $E_{min}$ is applied to the ink within chamber 13, causing the ink to be ejected through nozzle 20 towards a media sheet.

In lieu of employing a single heater resistor 16 at each ink jet chamber location, the invention provides a pair of resistors at each chamber which are driven in a half-select manner to enable sufficient power to be coupled to the ink in the chamber to enable that ink to be ejected through nozzle 20. Those skilled in the art will realize that the term "half-select" does not necessarily mean that exactly ½ the power is supplied by each resistor of the pair, but rather that each resistor provides a proportion of the applied power, with the proportion being less than that required to cause a level of thermal energy $E_{min}$ to be coupled to the ink within chamber 13. Thus, only when both resistors of the pair are supplied with current simultaneously (or substantially simultaneously) is sufficient energy coupled into the ink positioned in chamber 13 to cause it to be ejected from nozzle 20.

Figure 2:
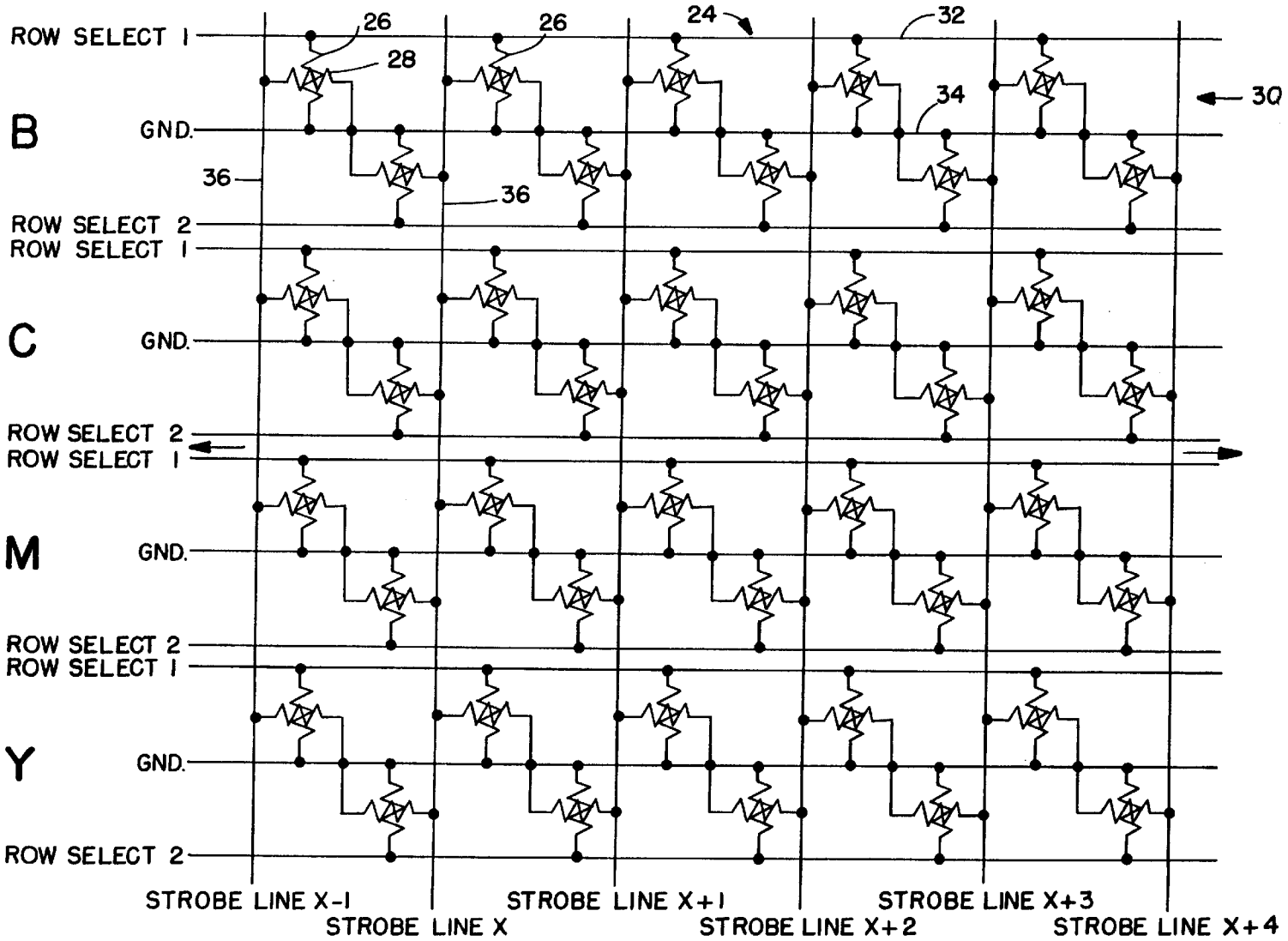
FIG. 2 is a circuit diagram of a first embodiment of the invention wherein an X-Y matrix selectively drives heater resistor pairs located at each ink jet ejection nozzle.

Referring to FIG. 2, an X-Y matrix drive circuit 24 is shown which enables ink jet ejection nozzles in a multicolor ink jet pen to be selectively addressed, using the dual resistor addressing arrangement of the invention. Each nozzle/chamber has a pair of resistors 26 and 28 positioned beneath the chamber and connected so as to the simultaneously driven by row and column drive circuits. Thus, each of resistors 26 in a first row 30 is connected between a row select conductor 32 and a ground conductor 34. When a half select drive voltage is applied to row select conductor 32, a half-select current is driven through each of resistors 26 to cause a heating thereof. However, as described above, the thermal energy imparted by each of resistors 26 to their associated ink reservoir chambers 13 is less than $E_{min}$.

Column selection is achieved by applying one or more strobe pulses to column lines 36. Each column line 36 connects to a plurality of resistors 28 whose other terminals are connected to an associated ground conductor (e.g. 34). By selectively energizing one or more of strobe lines 36, each resistor 28 associated with the energized strobe line has a voltage applied thereacross which causes a half-select current to flow therein. That current causes a heating of a resistor 28 which, in combination with the heat energy dissipated by resistor 26 at a fully selected chamber 13, causes the thermal energy coupled to the ink in chamber 13 to equal or exceed the value $E_{min}$. Under such circumstances, an ink droplet is ejected from nozzle 20 towards the media sheet.

Figure 3:
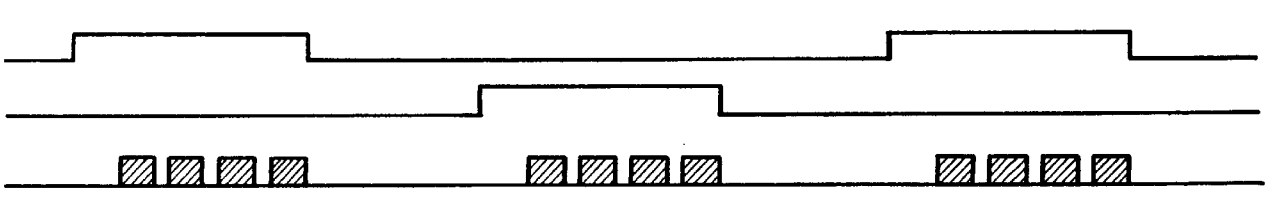
FIG. 3 is a waveform diagram illustrating signal levels applied to the X-Y lines of FIG. 2.

The circuit shown in FIG. 2 enables half select addressing of a full-color (black, cyan, magenta, and yellow) ink jet pen using dual resistor addressing. The waveforms shown in FIG. 3 illustrate the signals which implement the half-select addressing action.

Figure 4:
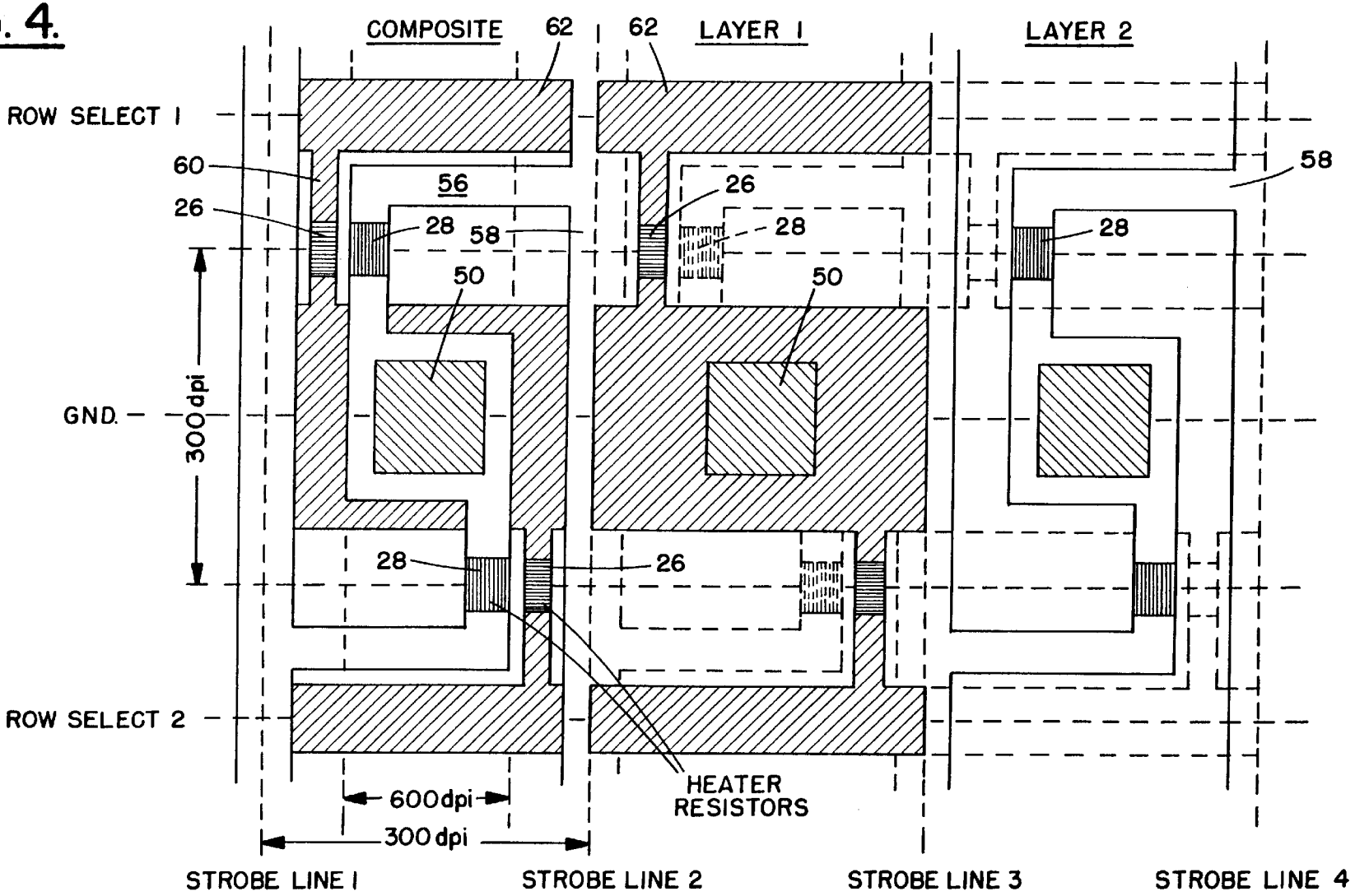
FIG. 4 is a planar view of multiple circuit levels of a pair of heater resistors that are off-set from each other when viewed from the ink jet ejection nozzle.

In FIG. 4, a plan view shows a substrate structure which configures the dual resistor drive arrangement. In the structure of FIG. 4, dual resistors 26, 28 are offset, but adjacent, as viewed from nozzle plate 18. The composite view at the left of FIG. 4 illustrates the plural, superposed circuit layers which achieve the dual resistor, half-select operation. A contact 50 enables connection of a ground conductor to each of heater resistors 26, 28. Each heater resistor 28 is connected via a conductor 56 to a strobe line 58. In similar fashion, each heater resistor 26 is connected by a conductor 60 to a row drive conductor 62. Note that heater resistors 26 and 28 are on different levels of metallization, but are placed adjacent each other and directly beneath an ink chamber.

To the right of the composite plan view of FIG. 4, is a view of "Layer 1" metallization showing how the row drive conductors 62 connect to heater resistors 26 and to ground contact 50. The illustration of the "Layer 2" metallization shows how heater resistors 28 connect to column strobe lines 58 for column selection.

Figure 5:
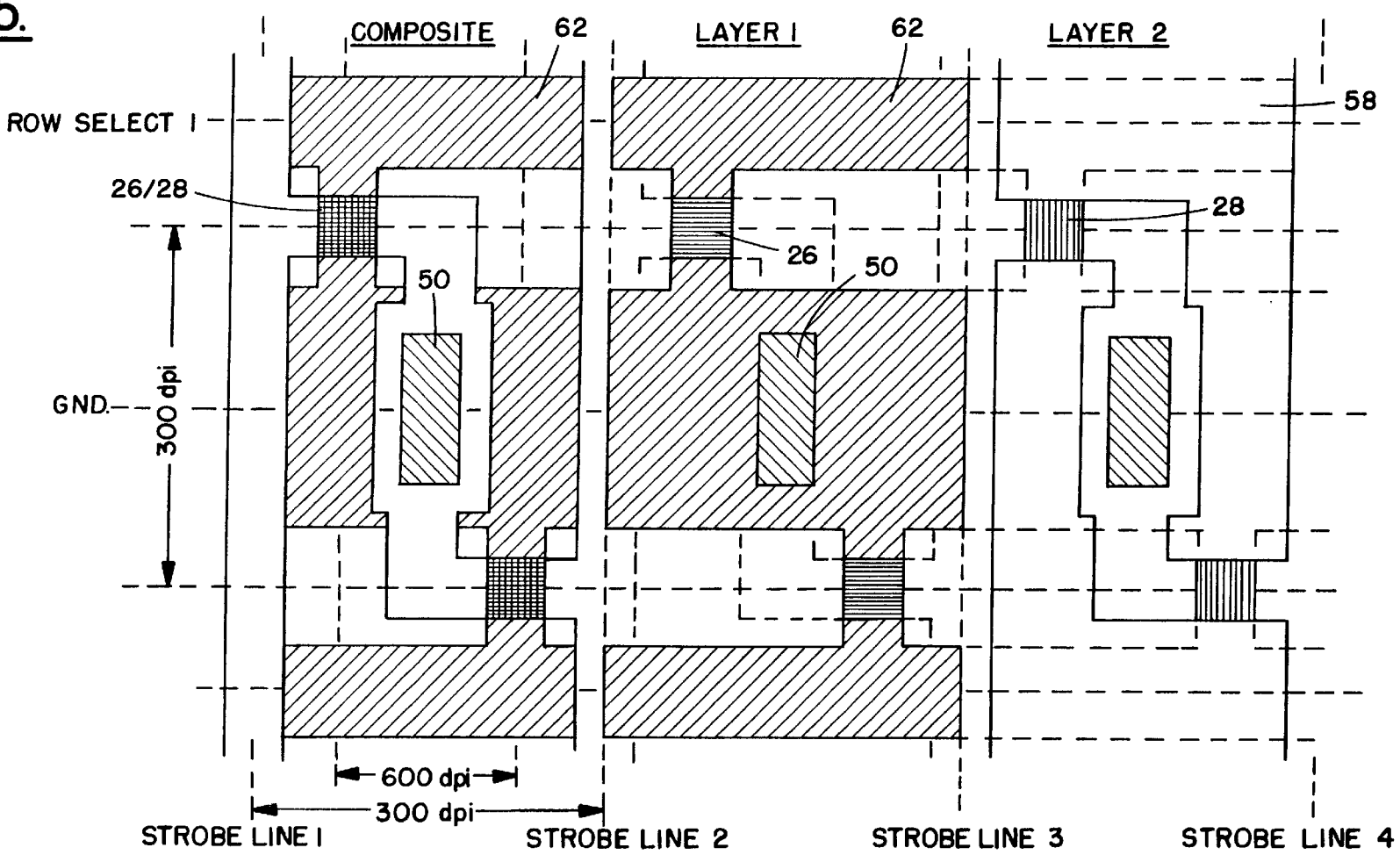
FIG. 5 is a planar view of multiple circuit levels of a pair of heater resistors that are overlaid upon each other when viewed from the ink jet ejection nozzle.

In FIG. 5, a similar structure to FIG. 4 is shown, however, heater resistors 26 and 28 are superposed over one another at each chamber and are separated by a dielectric layer (not shown). Thus, as can be seen in Layer 1 and Layer 2 in FIG. 5, the structure of row conductors 62 and strobe conductors 58 is somewhat altered to enable the achievement of the sandwich resistor structure.

Figure 6:
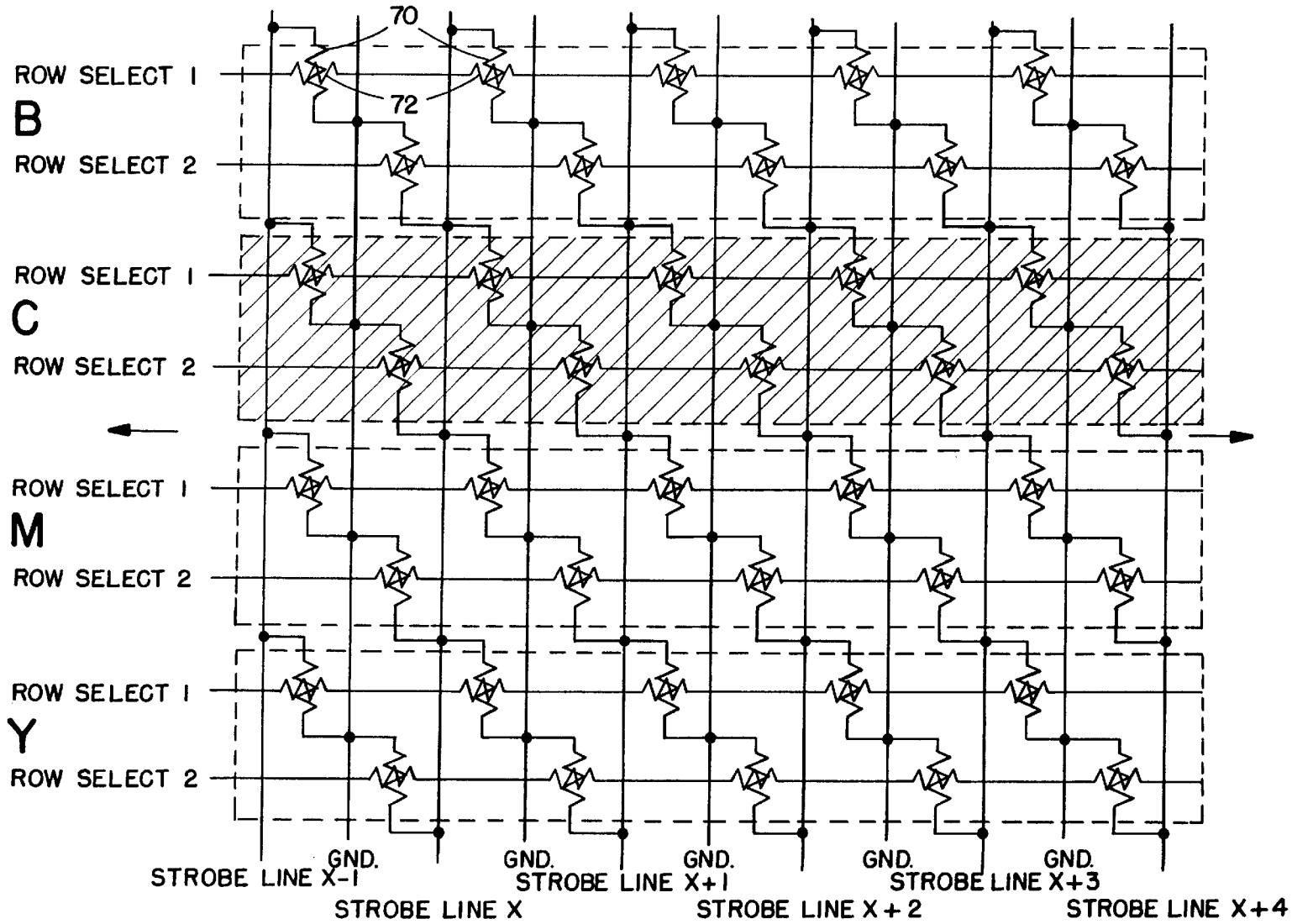
FIG. 6 is a circuit diagram of a second embodiment of the invention wherein an X-Y matrix selectively drives heater resistor pairs located at each ink jet ejection nozzle, without requiring electrical connection between plural circuit layers.

In FIG. 6, a further embodiment of the invention is illustrated wherein inter-circuit layer connections are not required. While heater resistors 70 are connected in parallel between parallel arranged strobe and ground conductors, heater resistors 72 are connected in series along each row of the matrix. Thus, no heater resistor needs be connected between intersecting row and column conductors. The serial resistor connection may dictate a shorter string of heater resistors 72 connected to a row select driver to assure sufficient thermal emission at each heater resistor 72.

In each of the above embodiments, it is critical that only when voltage is applied to both heater resistors located at a selected ink chamber, will the combined energy coupled into the ink at the selected nozzle equal or exceed $E_{min}$. The signals applied to the row select lines and the strobe lines do not have to be the same magnitude or duration and, thus, the term "half-select" is meant to incorporate any appropriate drive scheme which enables the above described addressing operation.

The thermal multiplexing arrangement described above enables a reduction of total signal lines and further enables the ink jet cells to be produced on relatively inexpensive substrates (e.g. ceramics or glass).

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. Thermal ink jet apparatus including an ink jet pen with a plurality of ink ejection nozzles and underlying ink chambers, said apparatus comprising:

a first heater resistor and a second heater resistor located at each chamber, said first heater resistor and said second heater resistor at each chamber disposed on different superposed circuitry layers;

means for introducing a quantum of ink into thermal communication with each said first resistor and said second resistor, said quantum of ink requiring at least a level $E_{min}$ of applied thermal energy to cause ink to be emitted from at least one of said chambers and through a corresponding nozzle at said at least one of said chambers;

an X matrix drive circuit for selectively applying a partial-select address current to said first heater resistor and a Y matrix drive circuit for selectively applying a partial-select address current to said second heater-resistor, said first heater resistor and second heater resistor being located at a common chamber, each partial-select current insufficient to cause a resistor to couple the level $E_{min}$ of thermal energy into said quantum of ink, but both partial-select currents causing at least the level $E_{min}$ of thermal energy to be coupled to said quantum of ink at said common chamber, wherein $E_{min}$ is the level of applied thermal energy required to eject a droplet of ink from an ink ejection nozzle.

2. The thermal ink jet apparatus as recited in claim 1, wherein said first heater resistor and said second heater resistor at each chamber are offset from each other when viewed from an ink emitting surface of said thermal ink jet apparatus.

3. The thermal ink jet apparatus as recited in claim 1, wherein said first heater resistor and said second heater resistor at each chamber are disposed in a stack when viewed from an ink emitting surface of said thermal ink jet apparatus.

4. The thermal ink jet apparatus as recited in claim 3, wherein said first heater resistor and said second heater resistor are separated by an insulating layer.

5. The thermal ink jet apparatus as recited in claim 1, wherein said X matrix drive circuit and said Y matrix drive circuit include a plurality of rows and columns, and further comprise:

a row select conductor for each row, each row select conductor for a row connected to one side of each said first resistor located at each chamber associated with said row;

a column select conductor for each column, each, column select conductor for a column connected to one side of each said second resistor located at each chamber associated with said column; and a common potential conductor connected to a second end of each said first resistor and each said second resistor.

6. The thermal ink jet apparatus as recited in claim 1, wherein said X matrix drive circuit and said Y matrix drive circuit include a plurality of rows and columns, and further comprise:

a row select conductor for each row, each row select conductor comprising a series connection of said first resistors, each said first resistor located at a chamber associated with said row;

a column select conductor for each column, each column select conductor for a column connected to one side of each said second resistor located at each chamber associated with said column; and a common potential conductor connected to a second end of each said second resistor.

7. The thermal ink jet apparatus as recited in claim 1, wherein each said partial select address current applied to a heater resistor causes said heater resistor to emit approximately a same value of thermal energy.

* * * * *